US005417165A

United States Patent [19]

Peppin et al.

[11] Patent Number: 5,417,165

[45] Date of Patent: May 23, 1995

[54] SELF-CLEARING DISCHARGE DOOR ASSEMBLY FOR RAILROAD BALLAST HOPPER CAR

[75] Inventors: Richard A. Peppin, Minnetonka; James S. Bell, Brooklyn Park, both of Minn.

[73] Assignee: Loram Maintenance of Way, Inc., Hamel, Minn.

[21] Appl. No.: 70,485

[22] Filed: Jun. 2, 1993

Related U.S. Application Data

[63] Continuation of Ser. No. 725,025, Jul. 3, 1991, abandoned.

[51] Int. Cl.[6] ..... B61D 7/02

[52] U.S. Cl. ..... 105/250; 222/557; 298/27

[58] Field of Search ..... 105/249, 251, 252, 282.2, 105/283; 222/536, 556, 557; 298/7, 27, 33

[56] References Cited

U.S. PATENT DOCUMENTS

| | | | |
|---|---|---|---|
| 2,020,863 | 11/1935 | Willoughby | 105/282.2 |
| 2,069,739 | 2/1937 | Fildes et al. | 222/547 X |
| 2,081,999 | 6/1937 | Hallquist et al. | 105/283 X |
| 2,317,007 | 4/1943 | Weniger | 105/282.3 X |
| 3,822,650 | 7/1974 | Fearon | 222/536 X |
| 4,361,096 | 11/1982 | Funk | 105/282.2 X |
| 4,528,913 | 7/1985 | Randolph | 105/282.2 |
| 4,545,446 | 10/1995 | Kokabu | 222/556 X |

FOREIGN PATENT DOCUMENTS

| | | | |
|---|---|---|---|
| 905757 | 7/1972 | Canada | 105/282.2 |
| 138295 | 10/1979 | Germany | 105/251 |

*Primary Examiner*—Michael S. Huppert
*Assistant Examiner*—Janice L. Krizek
*Attorney, Agent, or Firm*—Patterson & Keough

[57] ABSTRACT

A railroad hopper ballast discharge door assembly includes pliant side panels along a discharge gate opening. The pliant side panels are strong enough to retain the ballast within the hopper when the door is closed, yet are flexible enough to yield when ballast flowing out of the hopper becomes wedged between the side panel and the door as the door closes. Strengthening ribs reinforce the pliant side panels and may be embedded within them. The discharge door assembly is readily adapted for automatic, motor-actuated operation.

8 Claims, 7 Drawing Sheets

SELF-CLEARING DISCHARGE DOOR ASSEMBLY FOR RAILROAD BALLAST HOPPER CAR

This application is a continuing application of Ser. No. 07/825,025, filed Jul. 3, 1991, now abandoned.

TECHNICAL FIELD

This invention relates to the distribution of ballast along the track bed of a railroad track. In particular, the invention pertains to an improved discharge door for controlling the discharge of ballast from a hopper of a railroad ballast hopper car onto a railroad track bed.

BACKGROUND ART

Railway road beds must be capable of supporting extremely heavy rolling stock. Road beds have traditionally included closely spaced railroad ties for supporting the railroad rails. The ties in turn are supported by ballast comprising essentially debris-free rocks through which rain water can drain quickly.

Maintenance of the ballast in a railway road bed is a primary concern in extending the usefulness of the railway road bed. The ballast must be periodically replenished to ensure that the ties and rails are supported by an adequate amount of ballast. Maintenance of a railway road bed by cleaning or tamping the track bed ballast also often requires addition of ballast to the bed.

Adding ballast to a railway road bed by conventional means is time-consuming, labor intensive and dangerous. The additional ballast is transported to the stretch of track it will be deposited on by railroad ballast hopper cars. The cars have lowermost discharge doors that can be selectively opened to allow ballast to flow out of the car under the influence of gravity.

As the ballast hopper cars move along the rails at two to three miles per hour, a crew member walks beside the ballast hopper cars opening and closing the discharge doors to deposit ballast. A long metal lever is placed by the crew member in a tube attached to the discharge door to be opened or closed. The crew member, while walking alongside the moving hopper car, pushes the lever up or down to pivot the discharge door open or closed. The discharge doors are generally oriented directly above a rail, and include a chute or chutes that can be pivoted to either side of the rail for depositing ballast to the field side or the gauge side of the rail.

Frequently, when a crew member moves the lever back to its original position to close the discharge door, pieces of ballast become wedged in the opening between the hopper discharge gate and the discharge door. The crew member must push the lever quickly up and down, moving the discharge door just enough to free the ballast and close the discharge door before any more ballast becomes wedged. As the crew member works to unblock the discharge door, excess ballast may be discharged, resulting in the waste of some ballast. Moreover, pushing the lever up and down is physically demanding, and distracts the crew member from attention to his personal safety as he walks alongside the moving train. Manual operation of hopper discharge doors is particularly dangerous when a discharge door must be quickly closed prior to the ballast hopper car transiting across a bridge, switch track, or other obstacle.

It will also be appreciated that the wedging of ballast between the discharge gate and the discharge door prevents full closing of the ballast hopper discharge door and is an obstacle to the automatic operation of the discharge doors. In that regard, a motor trying to completely close a discharge door that is blocked from closing by wedged ballast would continue to run and draw power while seeking the closed position, leading to failure of the motor.

A self-clearing discharge door that rarely becomes blocked by ballast would provide a decided advantage to the railroad maintenance industry in terms of manpower, ballast wastage, and safety. Moreover, a discharge door capable of self-clearing blocking ballast could be easily adapted for the automatic, motor-assisted movement of the discharge door.

SUMMARY OF INVENTION

The problems outlined above are in large measure solved by the self-clearing discharge door assembly for a railroad ballast hopper car in accordance with the present invention. The discharge door assembly hereof includes a lowermost hopper gate aperture defined by front and rear walls and pliant side panels, and a pivoting door member for selectively opening and closing the hopper gate aperture. Ballast carried within the ballast hopper car flows through the gate aperture under the influence of gravity when the door member is in the open position. The gate aperture is preferably oriented directly over a rail, and the door member can be selectively positioned for depositing ballast on either the field side or the gauge side of the rail.

The hopper gate pliant side panels are strong enough to retain the ballast within the hopper when the door member is in the closed position, yet are flexible enough to yield when ballast becomes wedged between the side panel and the door member when the door member is shifted from the open position to the closed position. The pliant side panels are preferably comprised of a polyurethane elastomer. Fiberglass strengthening ribs reinforce the pliant side panels and may be embedded within the pliant side panels. The discharge door assembly in accordance with the present invention is readily adapted for automatic, motor-actuated operation.

DETAILED DESCRIPTION OF THE DRAWINGS

Figure 1:
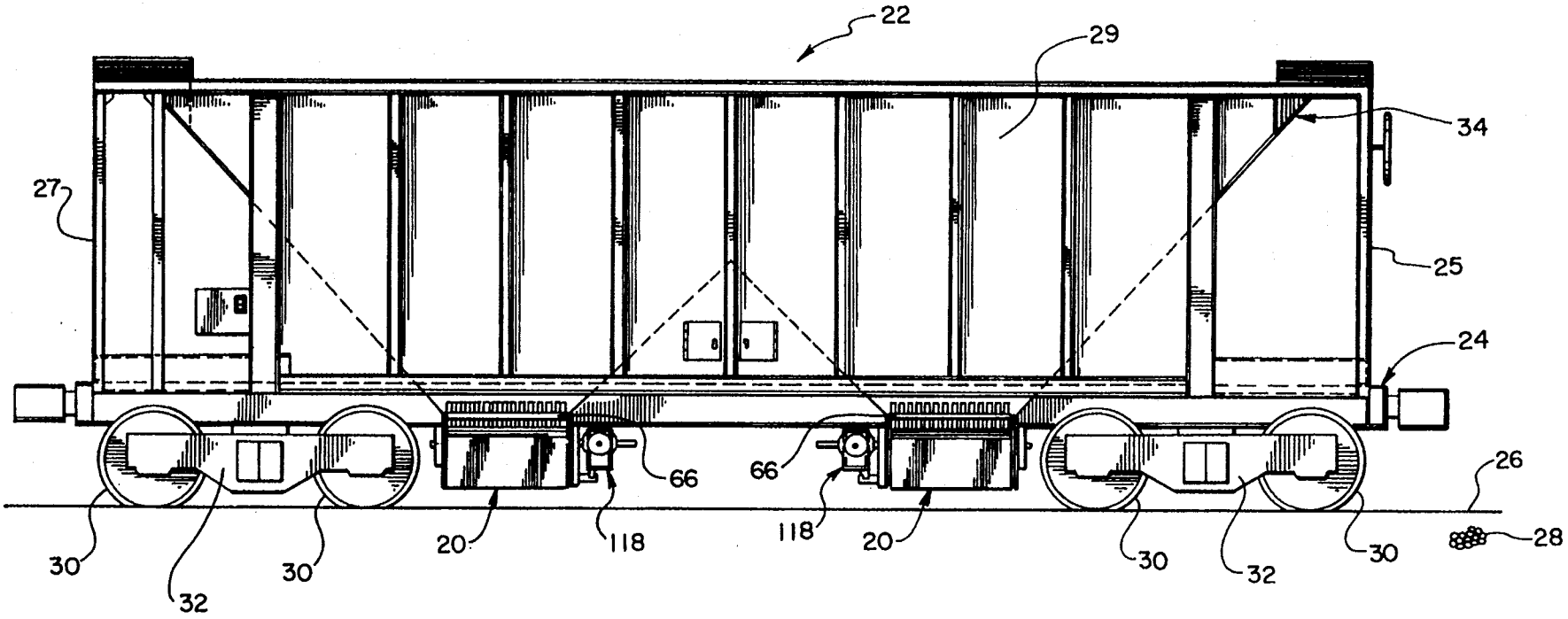
FIG. 1 is a side elevation view of a railroad ballast hopper car having multiple hoppers and discharge door assemblies.

Referring to the drawings, a self-clearing discharge door assembly 20 in accordance with the present invention is depicted as installed on a railroad ballast hopper car 22. The car 22 broadly includes a base frame 24 supported along parallel rails 26 of railway road bed 28 by rail engaging wheels 30. The base frame 24 includes car front wall 25, rear wall 27, and opposed side walls 29. The rail engaging wheels 30 are carried by respective wheel trucks 32, with each wheel truck 32 being pivotally coupled to the base frame 24.

Hopper frame 34, defining a plurality of hoppers 36, 38, 40, 42 is carried by the base frame 24. Each hopper 36, 38, 40, 42 occupies an equal one-fourth of the hopper frame 34. While only one hopper 40 is described in detail below, it will be understood that all of the hoppers 36, 38, 40, 42 are of similar construction and are annotated in the drawings with common numerals where appropriate.

Figure 2:
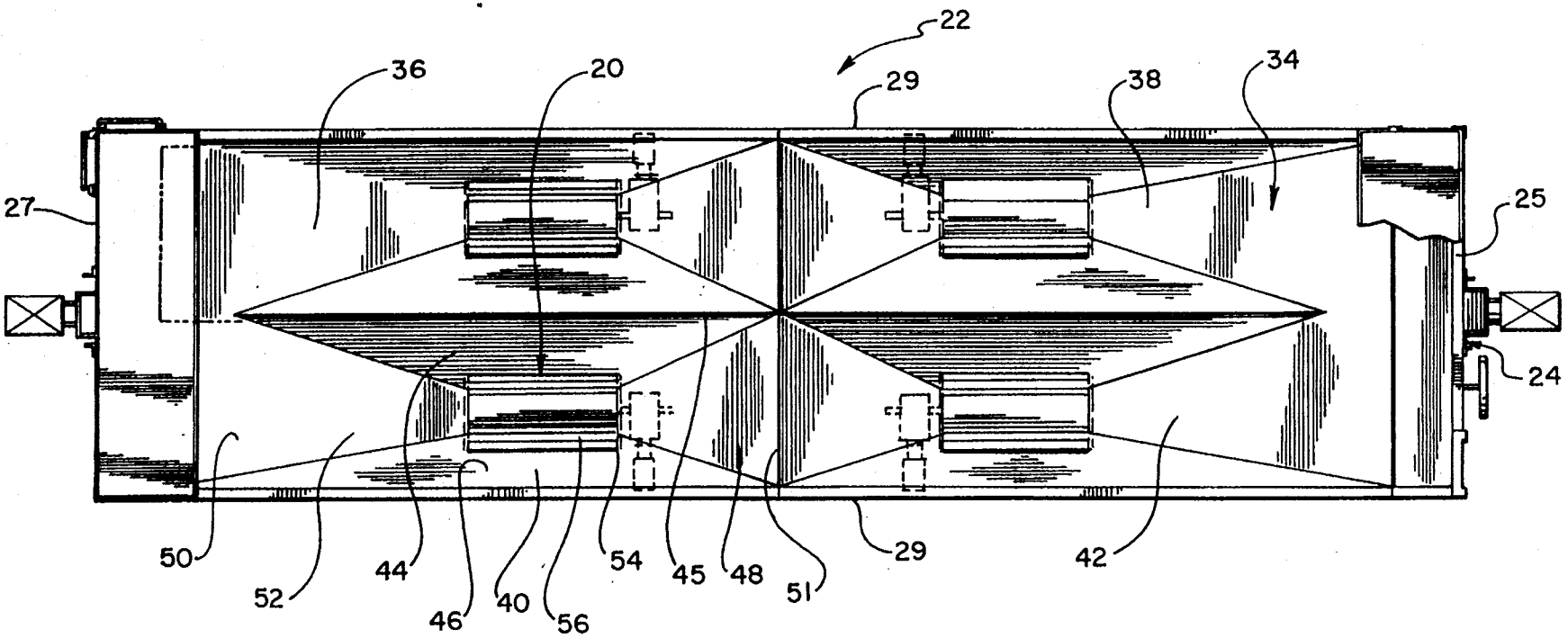
FIG. 2 is a top plan view of the railroad ballast hopper car depicted in FIG. 1.

Referring to FIG. 2, hopper 40 includes inner side wall 44 and opposed outer side wall 46, front wall 48 and rear wall 50. The front is to the right as viewed in FIG. 2, it being understood that "front" and "rear" are relative terms only, since the car 22 is capable of motion either to the right or left as viewed in FIG. 2. The inner side wall 44 of the hopper 40 extends downwardly and inwardly from its upper margin 45. The inner side wall upper margin 45 is oriented along a line dividing the hopper frame 34 in half lengthwise. The outer side wall 46 and rear wall 50 slope downwardly and inwardly from the top of the hopper frame 34. The front wall 48 extends downwardly and inwardly from its upper margin 51. The front wall upper margin 51 is oriented along a line parallel to and midway between the front wall 25 and rear wall 27. Referring to FIG. 1 and FIG. 2, it will be noted that the inner side wall 44 and front wall 48 do not extend to the top of the hopper frame 34. The inner side wall 44, outer side wall 46, front wall 48, and rear wall 50 of the hopper 40 define a rectangular funnel 52 which directs ballast downwardly towards the discharge door assembly 20 at the bottom of the hopper 40.

Figure 5:
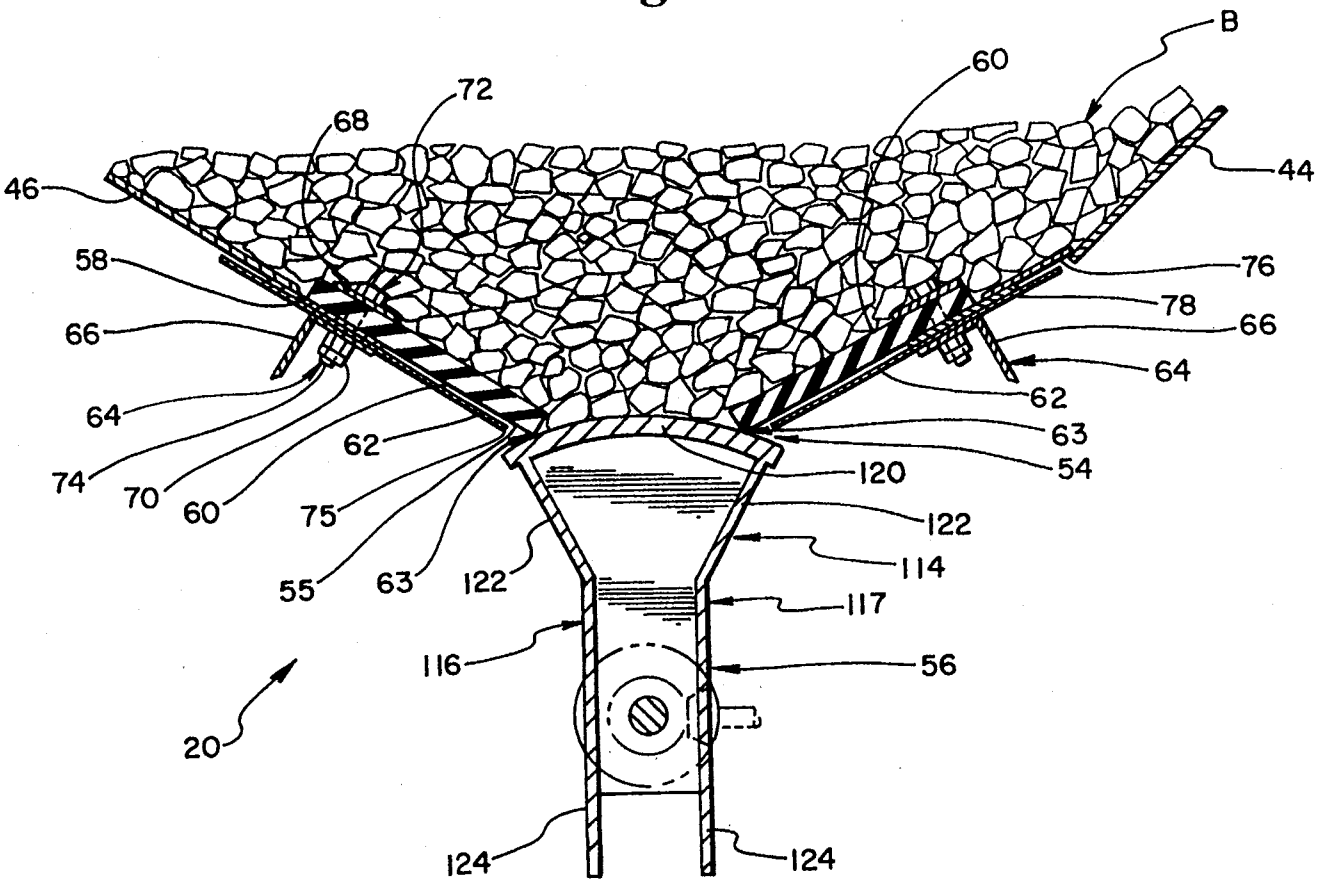
FIG. 5 is a sectional view taken along the line 5—5 of FIG. 4.

Referring to FIG. 5, each hopper discharge door assembly 20 includes a gate aperture 54 and a door member 56. The gate aperture 54 is defined by the lower margins of the hopper front wall 48, the rear wall 50, the inner side wall 44 and the outer side wall 46.

A pliant side panel 60 and plurality of semi-rigid ribs 62 are attached to the lower portion of the hopper outer side wall 46 by a connecting panel 58 and a connecting assembly 64. Strengthening channel 66 abuts the external face of the semi-rigid ribs 62. The pliant side panel 60 is comprised of a polyurethane elastomer such as that sold as Rhino Hyde CPA-850-950 series of products by Tandem Products, Inc. of Minneapolis, Minn. The semi-rigid ribs 62 are comprised of fiberglass such as that sold as Scotchply® brand composites by 3M of St. Paul, Minn.

The lower edges of the pliant side panels 60 comprise the lower margins of hopper side walls 44, 46. The peripheral margin 55 of gate aperture 54 includes a front peripheral margin 57 defined by the lower portion of hopper front wall 48, a rear peripheral margin 59 defined by the lower portion of hopper rear wall 50, and opposed side peripheral margins 63 defined by the lower edges of side panels 60.

Connecting assembly 64 includes bolster bar 68, and nut and bolt assembly 72. While only one combination of bolt 72, nut 70 and jam nut 74 is shown, it will be understood that a plurality of such assemblies are employed along the length of the channel 66 and bolster bar 68. Each bolt 72 passes through bolster bar 68, pliant side panel 60, connecting panel 58, the midportion of semi-rigid rib 62, and channel 66. The pliant side panel 60 extends beyond the lower edge 75 of the semi-rigid ribs 62. The lower edge 75 of each semi-rigid rib 62 just clears the door member 56. The lower edge of the pliant side panel 60 is engageable with the door member 56.

A pliant side panel 60 and plurality of semi-rigid ribs 62 also are attached to the inner side wall 44 in a similar manner to their attachment to the outer side wall 46. The outer side wall 46 includes an upper connecting panel 76 and a lower connecting panel 78 for strength and to accommodate the angle of the inner side wall 44.

Figure 4:
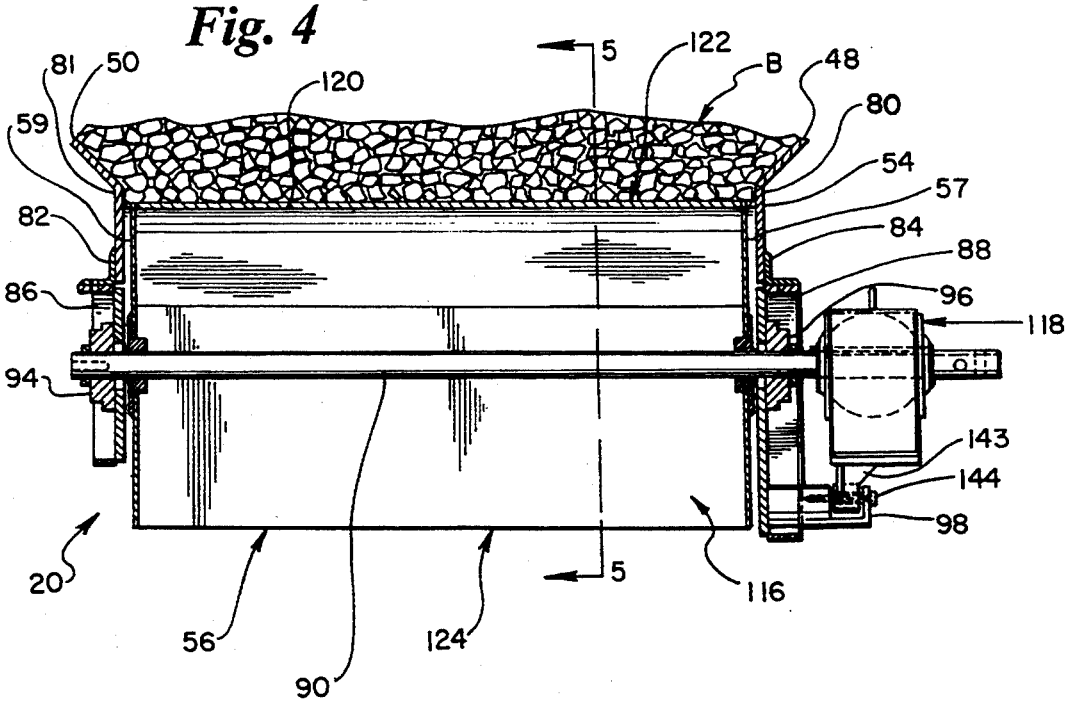
FIG. 4 is a vertical sectional view taken through the longitudinal rotational axis of the discharge door assembly depicted in FIG. 3.

Referring to FIG. 4, the lower portions of the hopper front and rear walls 48, 50 comprise downwardly depending generally upright panels 80, 81. Front brace 84 and rear brace 82 are bolted to respective panels 80, 81. The rear brace 82 removably carries a door member rear support panel 86 with detachable bolts (not shown). The front brace 84 removably carries door member front support panel 88. The door member 56 pivots about an axle 90 that extends between the door member front support panel 88 and door member rear support panel 86.

The rear support panel 86 includes a rear axle support collar 94 for receiving axle 90. The front support panel 88 includes a front axle support collar 96. A torque mount 98 is fastened to the right lowermost portion of the front support panel 88. Alternate attachment points 102, 104 for torque mount 98 are indicated in phantom lines in FIG. 3.

The door member 56 includes a gate head 114 defining opposed door chutes 116, 117. An arcuate gate face 120 is carried at the top of gate head 114 and extends beyond the side edges of the gate head 114. Each door chute 116, 117 includes a diverter panel 122 and a slide panel 124.

Figure 3:
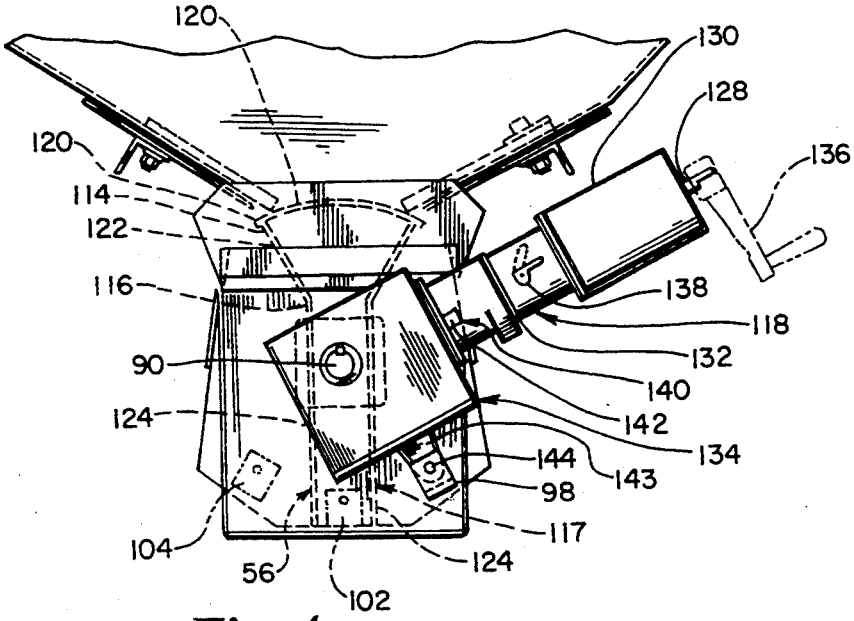
FIG. 3 is a fragmentary view of the railroad ballast hopper car depicted in FIG. 1, presenting a front elevational view of a discharge door assembly in accordance with the present invention.

A motor and gearbox assembly 118 is carried by front support panel 88 and includes motor shaft 128, motor 130, brake 132 and gear case 134. A hand crank 136, depicted in phantom lines in FIG. 3 is attachable to the motor shaft 128. The motor 130 can be a helical-bevel gear motor. The brake 132 is an electrically controlled friction brake and includes an external on/off switch 138 and a female connection modification 140. The brake 132 is mounted on the motor shaft 128 and, with the female connection modification 140, on the gear shaft 142 that extends from the gear case 134. The gear case 134 includes gear reducers such as SEW Euro-Drive Model KA76R42 or KA76R4 gear reducers available from Northwest Power Products, Inc. of Mendota Heights, Minn. Torque transmitting ear 143, carried by gear case 134, is coupled to torque mount 98 by torque pin 144.

Figure 9:
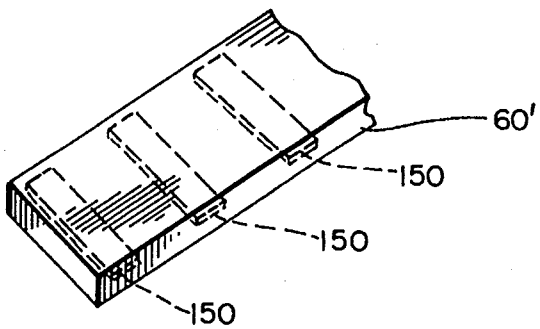
FIG. 9 is a fragmentary perspective view of an alternate form of a pliant side panel for the discharge door assembly.

FIG. 9 depicts an alternate embodiment of a polyurethane elastomer side panel 60' with embedded fiberglass strengthening ribs 150. The strengthening ribs 150 are evenly spaced along the length of the pliant side panel 60. Each strengthening rib 150 is embedded in the pliant side panel 60 at a depth an equal distance from either side of the pliant panel 60.

Figure 6:
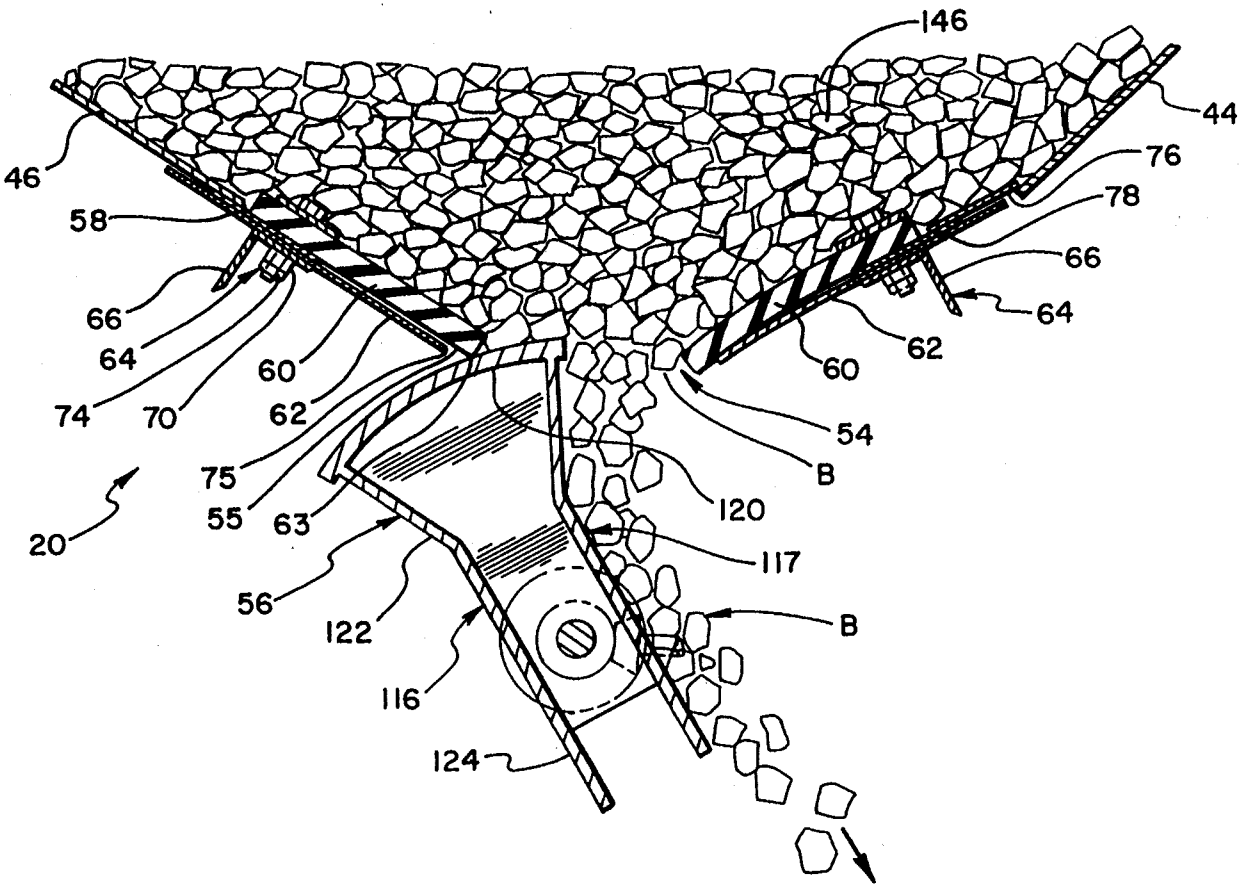
FIG. 6 is similar to FIG. 5 but with the discharge door member depicted in an open position.

In operation, the gate face 120 of the door member 56 blocks the gate aperture 54 when the door member 56 is centered and at rest. The door member 56 is pivotable about axle 90 to either side of the rail 26 to discharge ballast. Referring to FIG. 6, the door member 56 is depicted as pivoted to the left, clearing the gate aperture 54 allowing ballast B to fall out of the hopper 36, through the gate aperture 54 onto the door chute 117 and then onto the railway road bed 28 as shown by the arrow in FIG. 6.

The door member 56 is pivotable on axle 90 by the motor and gearbox assembly 118. The door member 56 is stopped and held in place by applying the brake 132 to the motor shaft 128. The motor 130 and brake 132 provide for pivoting of the door member 56 in small increments, for locking the door member 56 in a selected position and for closing of the door member 56 to center against the weight of the ballast. Alternatively, the door member 56 may be manually shifted by a crew member with hand crank 136.

Brake 132 engages the motor shaft 128 when the on/off switch 138 is on and there is no power to the motor 130. The brake 132 stops the swinging of the door member 56, counters the tendency of the door member 56 to rock backward when forward motion is stopped and eases the door member 56 into place. The female connection modification 140 of the brake 132 allows the brake to be positioned between the motor 130 and gear case 134 so that the motor and gearbox assembly 118 do not extend beyond the plane of the side of the railroad ballast hopper car 22.

Figure 7:
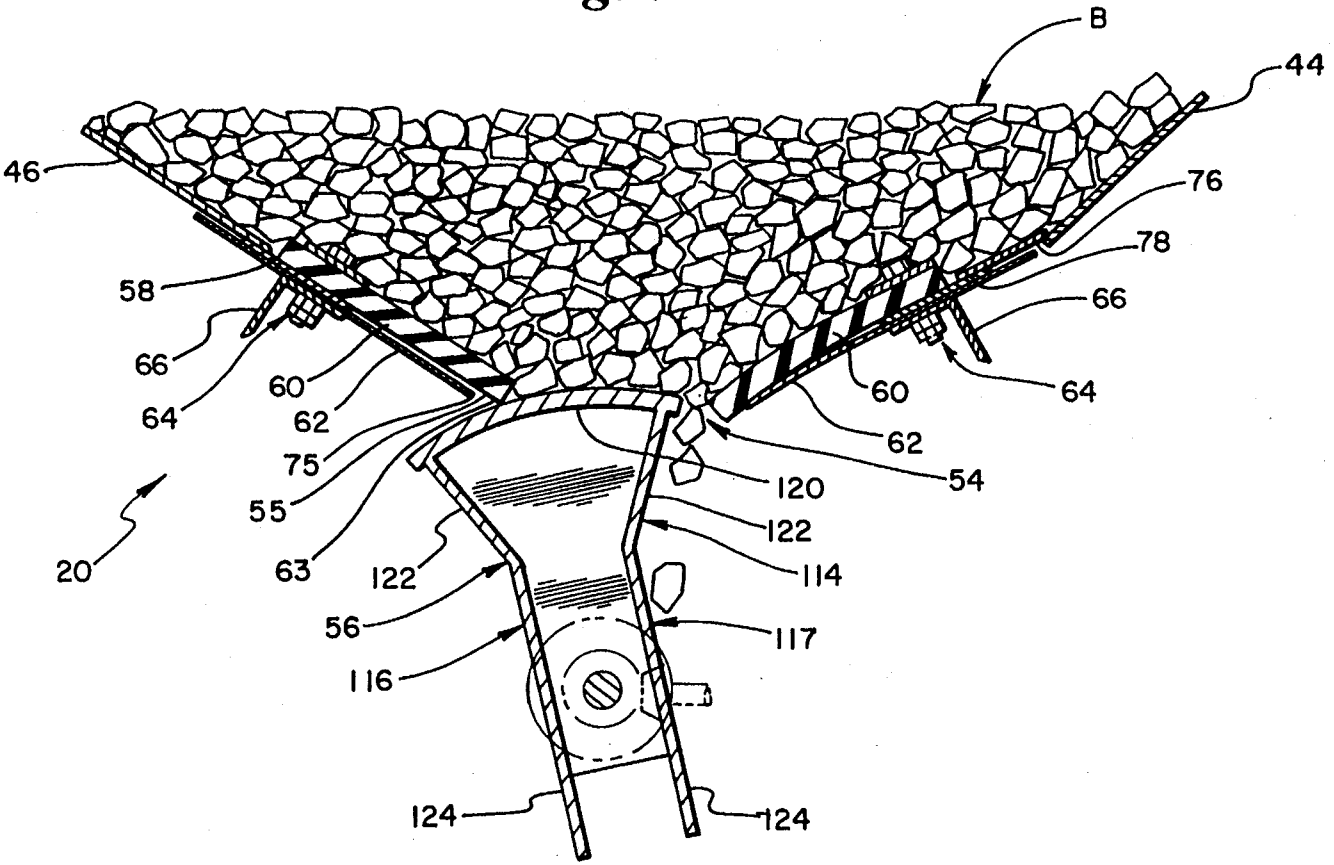
FIG. 7 is similar to FIG. 5 but with the discharge door member depicted in a partially closed position.
Figure 8:
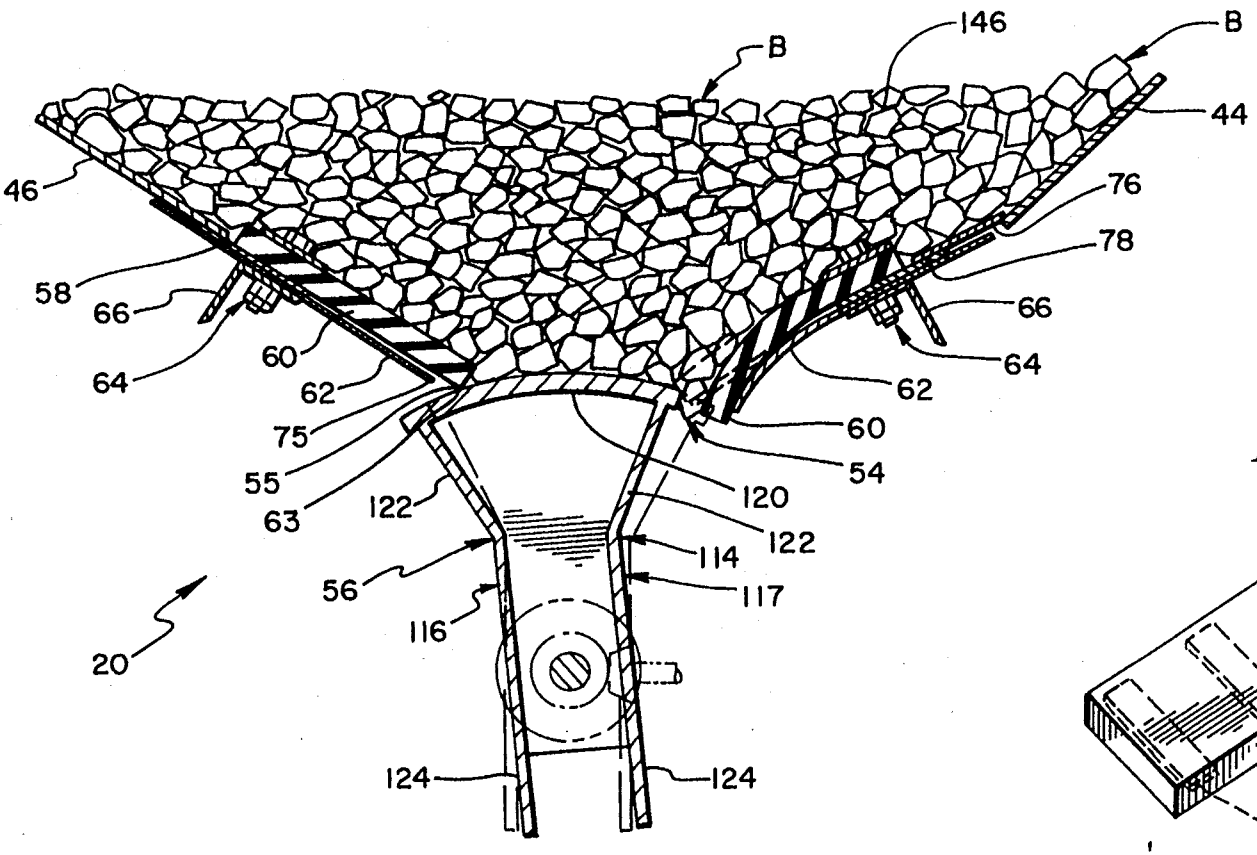
FIG. 8 is similar to FIG. 5 but with the discharge door member depicted in a nearly closed position, with phantom lines depicting the discharge door member in the fully closed position.

The self-clearing feature of door assembly 20 is demonstrated by the sequence of FIGS. 6–8.

Referring to FIG. 6, the discharge door 56 is depicted in the open position with ballast B exiting the gate aperture 54 and being diverted to the gate side of rail 26 along chute 117. It will be appreciated that ballast could be discharged along the field side of rail 26 by rotating the door member 56 clockwise, from the perspective of FIG. 6, such that the ballast B discharged through the gate aperture 54 would be diverted along chute 116 of door member 56.

FIG. 7 depicts the door member 56 in a partially closed position. The door 56 can be shifted from the open position of FIG. 6 into the closed position by actuating the motor and gear box assembly 118. The flow of ballast B through the gate aperture 54 is blocked by the gate face 120 of discharge door 56 as the discharge door 56 is rotated into place across the gate aperture 54. As is depicted in FIG. 7, pieces of ballast B can become wedged between the lip of the gate face 120 and the edge of the pliant panel 60 carried on the inner side wall 44 of hopper 40.

Referring to FIG. 8, the ballast B wedged between the lip of the door member gate face 120 and pliant panel 60 pushes against the pliant panel 60 as the door member 56 is rotated to the fully closed position (depicted in phantom lines in FIG. 8). The pliant panel 60 yields to the right, from the perspective of FIG. 8, allowing the door member 56 to rotate to the fully closed position notwithstanding the presence of ballast B wedged between the door member 56 and the pliant panel 60. The internal memory of the pliant panel 60, as well as the biasing effect of semirigid ribs 62 urges the pliant panel 60 towards its at-rest position (depicted in phantom lines in FIG. 8), prohibiting the exit of ballast B out of the hopper 40. In this manner, the door member 56 is self-clearing, since the door member 56 can be rotated from its open position to its fully closed position, notwithstanding the presence of ballast B within the hopper 40.

We claim:

1. A self-clearing discharge door assembly for a railway hopper car, the hopper car transporting a dischargeable material, comprising:

gate structure defining a downwardly facing hopper discharge opening, said discharge opening forming opposed side margins and opposed end margins;

a discharge control door operably supported by said gate structure for rotation about a pivotal axis oriented beneath said discharge opening, said door member including a generally arcuate, upwardly facing face plate selectively shiftable along a discharge control door path of travel between an open position clearing said discharge opening in which said material is dischargeable through said discharge opening and a closed position operably blocking the flow of said material through said discharge opening;

yieldable means operably coupled to said gate structure and extending beyond said side margins, said yieldable means having a depth that extends to engage said face plate, said yieldable means forming a yieldable juncture between said face plate and said side margin, said yieldable means generally sealingly, flexibly engaging said face plate along said juncture as said discharge control door is shifted along said path of travel, whereby said discharge control door is fully shiftable to said closed position from said open position while material is flowing through said discharge opening without material becoming jammingly engaged along said yieldable juncture.

2. The door assembly as claimed in claim 1, said yieldable means comprising a pliant side panel operably coupled to and extending beyond each of said side margins.

3. The door assembly as claimed in claim 2, wherein each of said pliant side panels is shiftable between a rest position and an extended position, said yieldable means including biasing means for urging said panels to said rest position.

4. The door assembly as claimed in claim 3, wherein each of said pliant panels comprises a polyurethane elastomer.

5. The door assembly as claimed in claim 4, said biasing means comprising a semi-rigid rib including memory means.

6. The door assembly as claimed in claim 5, said memory means comprising epoxy-impregnated continuous glass filaments in parallel alignment with each other for reinforcing said pliant panels.

7. The door assembly as claimed in claim 2, said yieldable means being coupled to said side margins by an elongate bar disposed on a first side of said yieldable means, a second side of said yieldable means being disposed proximate said side margins of said gate structure, fasteners extending from said elongate bar to said side margins and compressively engaging said yieldable means therebetween.

8. A self-clearing discharge door assembly for a railway hopper car, the hopper car transporting a dischargeable material, comprising:

gate structure defining a downwardly facing hopper discharge opening, said discharge opening forming opposed side margins and opposed end margins;

a discharge control door operably supported by said gate structure for rotation about a pivotal axis oriented beneath said discharge opening, said door member including a generally arcuate, upwardly facing face plate selectively shiftable along a discharge control door path of travel between an open position clearing said discharge opening in which said material is dischargeable through said discharge opening and a closed position operably blocking the flow of said material through said discharge opening;

yieldable means operably coupled to said gate structure and extending beyond said side margins, said yieldable means having a depth that extends to engage said face plate, said yieldable means forming a yieldable juncture between said face plate and said side margin and comprising a pliant side panel operably coupled to and extending beyond each of said side margins, wherein each of said pliant side panels comprises a polyurethane elastomer and is shiftable between a rest position and an extended position, said yieldable means including biasing means for urging said panels to said rest position, said biasing means comprising a semi-rigid rib including memory means, said memory means comprising epoxy-impregnated continuous glass filaments in parallel alignment with each other for reinforcing said pliant panels, said yieldable means generally sealingly, flexibly engaging said face plate along said juncture as said discharge control door is shifted along said path of travel, whereby said discharge control door is fully shiftable to said closed position from said open position while material is flowing through said discharge opening without material becoming jammingly engaged along said yieldable juncture.

* * * * *

UNITED STATES PATENT AND TRADEMARK OFFICE

CERTIFICATE OF CORRECTION

PATENT NO. : 5,417,165
DATED : May 23, 1995
INVENTOR(S) : Richard A. Peppin and James S. Bell It is certified that error appears in the above-indentified patent and that said Letters Patent is hereby corrected as shown below:

Column 1, line 6, delete "07/825,025" and substitute therefor --07/725,025--.

Signed and Sealed this

Twenty-second Day of August, 1995

*Attest:*

*Attesting Officer*

BRUCE LEHMAN

*Commissioner of Patents and Trademarks*